United States Patent [19]

Mascetti

[11] Patent Number: 4,713,950

[45] Date of Patent: Dec. 22, 1987

[54] DEVICE ADAPTED TO MOVE THE SHARPENING GRINDING WHEELS IN A LEATHER SPLITTING MACHINE CLOSE TO AND AWAY FROM A CUTTING BLADE

[75] Inventor: Paolo Mascetti, Milan, Italy

[73] Assignee: Camoga S.p.A., Milan, Italy

[21] Appl. No.: 891,769

[22] Filed: Jul. 30, 1986

[30] Foreign Application Priority Data

May 7, 1986 [IT] Italy ..... 21753 B/86

[51] Int. Cl.[4] ..... C14B 1/18

[52] U.S. Cl. ..... 69/10; 83/174; 51/247

[58] Field of Search ..... 69/9, 10, 21.5, 36; 83/174, 661; 51/247

[56] References Cited

U.S. PATENT DOCUMENTS 2,234,352 3/1941 Plass ..... 69/10 X 2,524,013 9/1950 Hall ..... 69/10

3,864,880 2/1975 Repetto ..... 69/10 X

*Primary Examiner*—Wm. Carter Reynolds

*Attorney, Agent, or Firm*—Thomas R. Vigil

[57] ABSTRACT

A device to move the sharpening grinding wheels in a leather splitting machine close to and away from a cutting blade. The grinding wheels are rotatably supported on the end portions of respective arms the other ends of which are pivoted on a carriage. The carriage, slidably movable on guiding rods, through an actuator, moves the grinding wheels from a position in which the latter are engaged on the bevel of the cutting blade to a position in which they are not in contact with the blade. In order to bring the grinding wheels back to the operative position on the cutting blade bevel, spring means is provided between the carriage and a bar rigidly connected to the splitting machine.

11 Claims, 3 Drawing Figures

DEVICE ADAPTED TO MOVE THE SHARPENING GRINDING WHEELS IN A LEATHER SPLITTING MACHINE CLOSE TO AND AWAY FROM A CUTTING BLADE

BACKGROUND OF THE INVENTION

1. Field of the Invention

The present invention relates to a device adapted to move the sharpening grinding wheels in a leather splitting machine close to and away from a cutting blade.

2. Prior Art

It is known that splitting machines substantially consist of a band blade disposed around a pair of flywheels or pulleys having axes substantially parallel to each other. The band blade has the function of carrying out a thinning cut in a leather sheet which is thereby divided into two layers one of them being generally valuable and the other having to be discarded.

As leathers to be worked are often very thin, it is indispensable for the band blade to act very precisely and for the blade bevel or cutting edge to be always perfectly sharpened. For the purpose splitting machines are provided with a grinding unit consisting of a pair of grinding wheels symmetrically disposed relative to the cutting blade bevel and continuously acting during the machine operation.

Grinding wheels are provided with adjusting means allowing them to be correctly located in relation to the blade bevel but they are mounted on a fixed supporting structure so that they cannot be moved away from the cutting blade when the latter is moving.

Owing to this fixed positioning of the grinding wheels in operative engagement with the cutting blade, it has been remarked that when the splitting machine is stopped, a sort of furrow or notch is created in the bevel which subsequently causes, when the splitting machine is again operated, undesired marks and engravings on the splitted leather. In fact, by effect of the respective inertias when the machine is stopped, the cutting blade tends to immediately halt, while the grinding wheels go on turning so that they sharpen the blade at one point only which causes said furrow.

OBJECTS

The main object of the present invention is to obviate the drawbacks associated with the splitting machines of known type in which the band blade is combined with a group of sharpening grinding wheels that are always operatively connected to the cutting blade, by providing a device allowing to move the grinding wheels away from the blade when the splitting machine is stopped.

A further important object of the present invention is to provide a device of the above specified type which, when the operation of moving the sharpening grinding wheels close to the cutting blade is carried out, does not need any adjustment by the operator so that the correct positioning of the grinding wheels with respect to the blade bevel may be restored.

A still further object of the present invention is to provide a device of the above specified type which can be operated not only automatically when the splitting machine is started or stopped, but, in case of need, at any moment of the machine operation cycle.

SUMMARY OF THE INVENTION

The foregoing and still further objects that will become more apparent in the following are achieved, according to the present invention, by a device adapted to move the sharpening grinding wheels in a leather splitting machine close to and away from a cutting blade of the type comprising a pair of grinding wheels disposed symmetrically relative to the bevel of the cutting blade, at right angles to the same, and further comprising a carriage slidably movable along guiding rods, a pair of arms each of them having one end pivoted on said carriage while the opposite end carries the sharpening grinding wheels, control means for moving said carriage from one position in which the grinding wheels are operatively engaged on the cutting blade bevel to a second position in which the grinding wheels are not in contact with the cutting blade and repositioning means for returning the grinding wheels to their operative position on the cutting blade bevel.

BRIEF DESCRIPTION OF THE DRAWINGS

Further features and advantages of the invention will become more apparent from the detailed description of a preferred but not exclusive embodiment of a device for moving the sharpening grinding wheels in a leather splitting machine close to and away from a cutting blade, taken hereinafter by way of non-limiting example with reference to the accompanying drawings, in which.

DESCRIPTION OF THE PREFERRED EMBODIMENT

Figure 1:
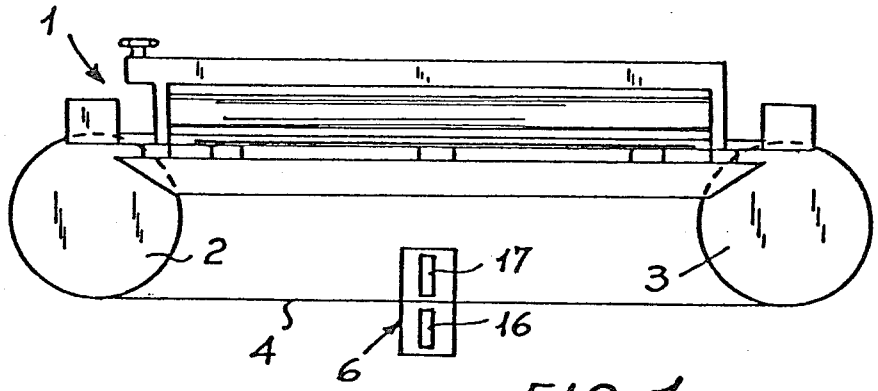
FIG. 1 is a front diagrammatic view of a splitting machine provided with a sharpening grinding unit.

Referring to the drawings and particularly to FIG. 1, a splitting machine of a conventional type including a pair of flywheels 2 and 3 one of which is a driving flywheel, has been globally identified by reference numeral 1. A band blade 4 is disposed around said flywheels 2 and 3. In the region of the lower portion of blade 4 a pair of sharpening grinding wheels 16 and 17 are provided which are associated, in a manner to be explained hereinafter, with a device globally identified at 6, adapted to move the grinding wheels close to and away from the cutting blade 4.

Figure 2:
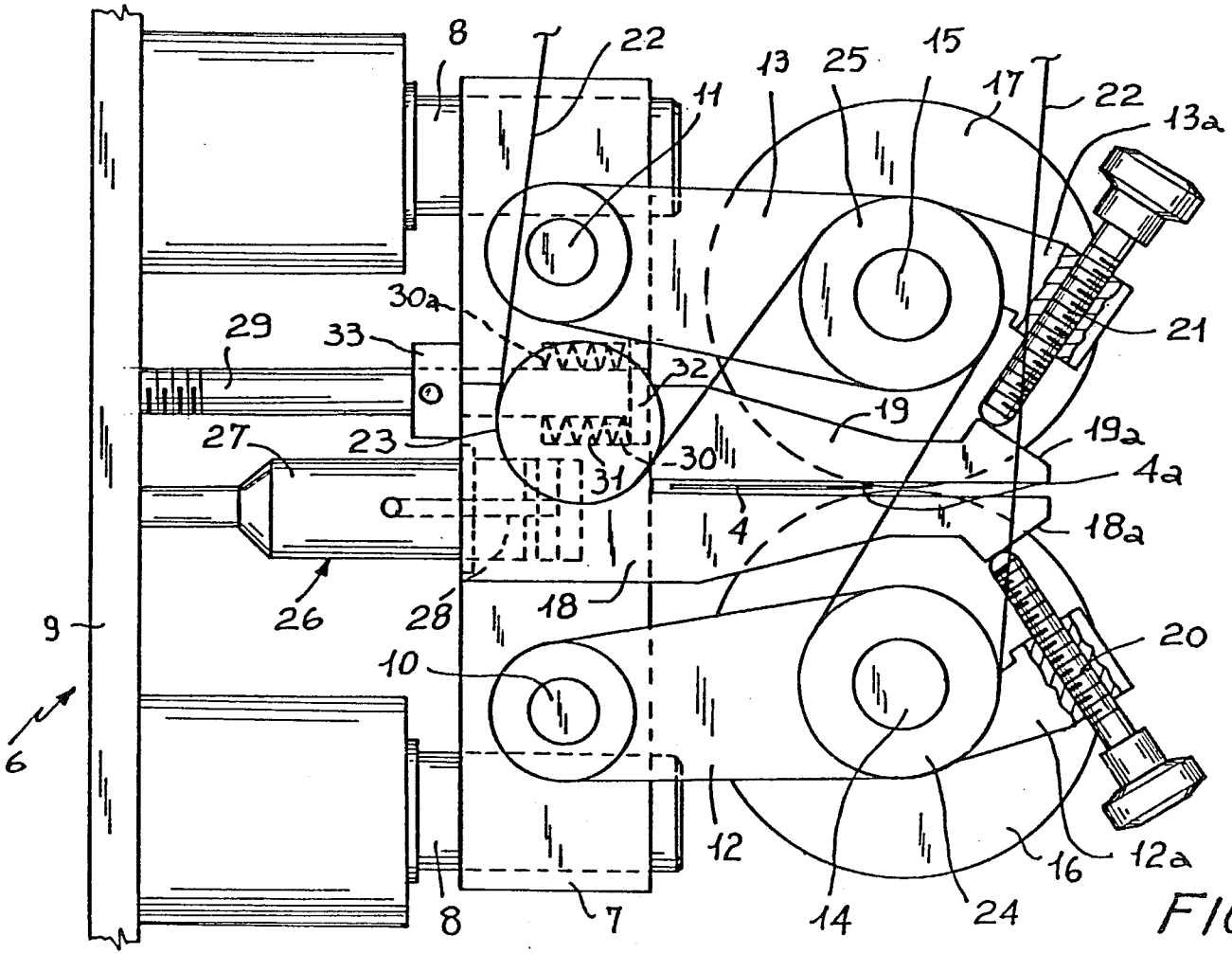
FIG. 2 is a longitudinal sectional view of the device for moving the sharpening grinding wheels close to and away from the cutting blade, according to the present invention.

Referring particularly to FIG. 2, the device 6 substantially comprises a carriage 7 slidably mounted on a pair of guiding rods 8 fixed on a support 9 integral with the splitting machine casing.

A pair of arms 12 and 13 have one end thereof pivoted, at 10 and 11 respectively, on carriage 7, whereas the opposite end of said arms carries the sharpening grinding wheels 16 and 17 fitted thereon at 14 and 15 respectively.

Always referring to FIG. 2, 18 and 19 denote a pair of arms integral with carriage 7 and projecting at right angles therefrom, symmetrically to the cutting blade 4. Each arm 18 and 19 is provided with an abutment surface 18*a* and 19*a* against which an adjusting screw 20 and 21 is intended to abut, said screw being adapted to set the correct axial distance of the grinding wheels 16 and 17 from the bevel 4*a* of the cutting blade 4. For the purpose, it is to be noted that arms 12 and 13 have a projecting portion 12*a* and 13*a* provided with a threaded through hole in which the adjusting screw 20-21 is screwed.

Spring means is provided in order to hold the grinding wheels 16 and 17 axially close to each other. It consists, for example, of a driving belt 22 which receives the movement from a pulley fixedly fitted on the shaft of a motor controlling the grinding wheels, not shown in the figures, and which, after surrounding an idler wheel 23, engages pulleys 24 and 25 integral with the grinding wheels 16 and 17 in the manner shown in FIG. 2.

For moving carriage 7 from a position in which the grinding wheels 16 and 17 are operatively engaged on bevel 4*a* of the cutting blade to a position in which the grinding wheels are not in contact with blade 4, control means consisting of a fluid-operated actuator 26 of the cylinder-plunger type is provided, in which the cylinder 27 is rigidly fastened to support 9 and the plunger 28 is made integral with carriage 7. Furthermore, repositioning means is provided, being designed to return the grinding wheels 16 and 17 to their operative position on bevel 4*a* of blade 4 when the action of actuator 26 ceases. This means comprises a partially threaded bar 29 which is screwed, at one end thereof, on support 9 and at the opposite end is slidably fitted in a through hole bored on carriage 7. A housing 30 is also obtained in carriage 7 which is adapted to accommodate at least a return spring. In the embodiment shown in FIG. 2 a pack of cup-shaped springs 31 is provided, which springs act between an inner shoulder 30*a* of hole 30 and an abutment 32 rigidly carried at one end of bar 29. In addition on said bar 29 it is also rigidly mounted a stop member 33 adapted to snugly restrain the movements of carriage 7 to its return position and consequently of the grinding wheels 16 and 17 onto bevel 4*a* of the cutting blade 4.

The actuator 26 is driven by an electrovalve 34 or the like which is oleodynamically connected to the actuator 26 itself in order to send working fluid to the latter. The electrovalve 34 is part of an electric circuit generally identified at 35 and shown in FIG. 3, in turn connected to the general circuit of the splitting machine suitably powered from network 35*c*.

Figure 3:
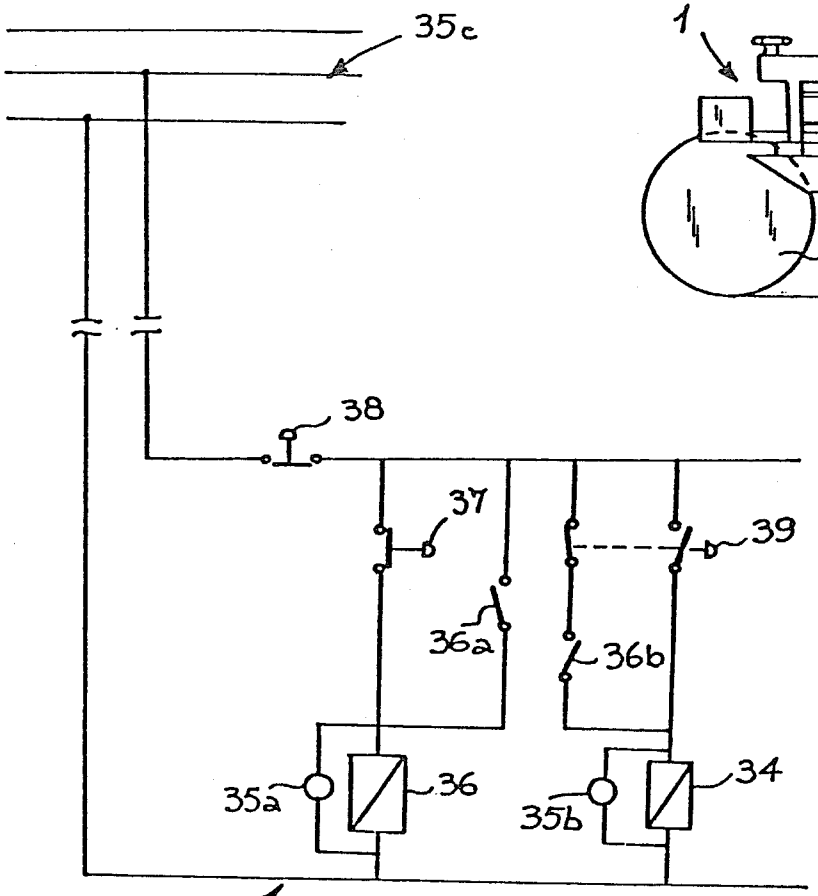
FIG. 3 is a diagrammatic view of a simplified electric circuit enabling operation of the device according to the present invention.

As shown in FIG. 3, 36 denotes a relay allowing the operation of the whole splitting machine. The relay 36 is electrically connected to the electrovalve 34 and controls one relay contact 36*a* designed to keep the relay 36 in its energized or de-energized condition, as well as a second relay contact 36*b* designed to maintain the electrovalve 34 in an activated or deactivated condition. The relay 36 is first energized by a start pushbutton 37 and deenergized by a stop pushbutton 38.

Still referring to FIG. 3, 39 denotes a selector connected to the electrovalve 34 and designed to allow the device for moving the grinding wheels away from the cutting blade, to be manually connected to the circuit.

In more detail, when the splitting machine is operated, the energization of relay 36 causes the first relay contact 36*a*, which is normally open, to be closed and the second relay contact 36*b*, which is normally closed, to be opened, so that the electrovalve 34 is deactivated and the grinding wheels 16 and 17 are in contact with the bevel 4*a* of the cutting blade 4. Referring to FIG. 2, when electrovalve 34 is deactivated the plunger 28, which is integral with the carriage 7, is moved towards the left due to the bias of spring 31. When the machine is stopped, acting on the stop pushbutton 38 the de-energization of the relay 36 is caused and, as a result, the opening of contact 36*a* and closing of contact 36*b* so that the electrovalve 34 is actuated and the grinding wheels are moved away from the cutting blade 4. Actuation of electrovalve 34 causes plunger 28 to move rightward, moving grinding wheels 16, 17 away from blade bevel 4*a*. LEDS 35*a* and 35*b* connected to relay 36 and electrovalve 34 respectively, display the ON/-OFF condition of the latter.

According to a further feature of the invention, the grinding wheels can be moved apart from blade 4 also during a normal operation cycle of the splitting machine. To this end it is sufficient to act upon selector 39 which directly activates the electrovalve 34 thereby causing the carriage 7, and consequently the grinding wheels 16 and 17, to move away from blade 4.

The invention attains the intended purposes.

By virtue of the structure of the above described device it is possible to move the grinding wheels away from the cutting blade when the splitting machine is stopped so that no damages may occur either to the cutting blade or to the grinding wheels, which damages would be irreversible in the case of use of diamond grinding wheels.

Furthermore, by virtue of the automatic repositioning means of the present invention, when the grinding wheels 16 and 17 are brought again into contact with the bevel 4*a* of the cutting blade 4, there is no need for a manual intervention on the part of the operator in order to adjust the position of the grinding wheels because the repositioning of the same takes place with the greatest accuracy.

Obviously many modifications and variations can be made to the device of the invention without departing from the scope of its inventive idea. In particular, all circuit components as well as the cylinder 27 operating carriage 7 and the electrovalve 34 actuating cylinder 27 can be replaced by other technically equivalent elements.

What is claimed is:

1. A device to move the sharpening grinding wheels in a leather splitting machine close to and away from a cutting blade comprising:

a pair of grinding wheels symmetrically disposed relative to the bevel of the cutting blade;

a carriage slidably movable along guiding rods;

a pair of arms each of them having one end pivoted on said carriage and the opposite end connected to one of the grinding wheels;

control means adapted to automatically move the carriage from a position in which the sharpening grinding wheels are operatively engaged on the cutting blade bevel to a position in which the grinding wheels are spaced apart from the cutting blade; and repositioning means designed to automatically return the grinding wheels into engagement with the bevel of the cutting blade.

2. The device as claimed in claim 1 wherein said control means comprises:

an actuator connected, at one end thereof, to said carriage and at the opposite end to a support in the splitting machine;

an electric valve oleodynamically connected to the actuator to send working fluid to the actuator itself;

a relay electrically connected to the electrovalve;
one relay contact for maintaining the relay in an energized or de-energized condition;
a second relay contact for maintaining the electrovalve in an activated or deactivated condition;
a start pushputton to energize the relay; and
a stop pushbutton to de-energize the relay.

3. The device as claimed in claim 2, wherein said control means further comprises a selector electrically connected to the electrovalve in order to activate and deactivate the same independently of the energized or de-energized condition of the relay.

4. The device as claimed in claim 1, wherein said repositioning means comprises a bar rigidly connected to the splitting machine and slidably inserted in a hole bored in the said carriage and at least a spring acting between the carriage and an abutment on the bar, said bar being provided with a stop member to limit the displacements of the carriage pushed by the spring.

5. The device as claimed in claim 1, further comprising a pair of arms located at right angles to the carriage and symmetrically to the cutting blade, each of said arms being provided with a reference surface against which an adjusting screw adapted to adjust the axial distance between each grinding wheel and the cutting blade bevel abuts.

6. The device as claimed in claim 1, further comprising spring means designed to hold the grinding wheels close to each other, said spring means consisting of a driving belt for transmitting the movement of the grinding wheels.

7. A device to move the sharpening grinding wheels in a leather splitting machine close to and away from a cutting blade comprising:
a pair of grinding wheels symmetrically disposed relative to the bevel of the cutting blade;
a carriage slidably movable along guiding rods;
a pair of arms each of them having one end pivoted on said carriage and the opposite end connected to one of the grinding wheels;
control means adapted to automatically move the carriage from a position in which the sharpening grinding wheels are operatively engaged on the cutting blade bevel to a position in which the grinding wheels are spaced apart from the cutting blade said control means including:
an actuator connected, at one end thereof, to said carriage and at the opposite end to a support in the splitting machine,
an electric valve oleodynamically connected to the actuator to send working fluid to the actuator itself,
a relay electrically connected to the electrovalve,
one relay contact for maintaining the relay in an energized or de-energized condition,
a second relay contact for maintaining the electrovalve in an activated or deactivated condition,
a start pushbutton to energize the relay,
a stop pushbutton to de-energize the relay; and
repositioning means designed to automatically return the grinding wheels into engagement with the bevel of the cutting blade.

8. The device as claimed in claim 7, wherein said control means further comprises a selector electrically connected to the electrovalve in order to activate and deactivate the same independently of the energized or deenergized condition of the relay.

9. The device as claimed in claim 7, wherein said repositioning means comprises a bar rigidly connected to the splitting machine and slidably inserted in a hole bored in the said carriage and at least a spring acting between the carriage an an abutment on the bar, said bar being provided with a stop member to limit the displacements of the carriage pushed by the spring.

10. The device as claimed in claim 7, further comprising a pair of arms located at right angles to the carriage and symmetrically to the cutting blade, each of said arms being provided with a reference surface against which an adjusting screw adapted to adjust the axial distance between each grinding wheel and the cutting blade bevel abuts.

11. The device as claimed in claim 7, further comprising spring means designed to hold the grinding wheels close to each other, said spring means consisting of a driving belt for transmitting the movement of the grinding wheels.

* * * * *